US012123668B2

(12) United States Patent
Kolev et al.

(10) Patent No.: US 12,123,668 B2
(45) Date of Patent: Oct. 22, 2024

(54) AMBIDEXTROUS BOLT CATCH FOR USE WITH A FIREARM

(71) Applicant: COLT'S MANUFACTURING COMPANY LLC, West Hartford, CT (US)

(72) Inventors: Ivan Kolev, Suffield, CT (US); Donald Senchuk, New Britain, CT (US); Brett Tannone, Thomaston, CT (US)

(73) Assignee: COLT'S MANUFACTURING COMPANY LLC, West Hartford, CT (US)

( * ) Notice: Subject to any disclaimer, the term of this patent is extended or adjusted under 35 U.S.C. 154(b) by 0 days.

(21) Appl. No.: 18/125,827

(22) Filed: Mar. 24, 2023

(65) Prior Publication Data

US 2024/0318934 A1 Sep. 26, 2024

(51) Int. Cl.

| | |
|---|---|
| ***F41A 35/06*** | (2006.01) |
| ***F41A 3/38*** | (2006.01) |
| ***F41A 3/72*** | (2006.01) |
| ***F41A 17/36*** | (2006.01) |

(52) U.S. Cl.

CPC ..... *F41A 17/36* (2013.01); *F41A 3/38* (2013.01); *F41A 3/72* (2013.01); *F41A 35/06* (2013.01)

(58) Field of Classification Search

CPC ..... F41A 17/34; F41A 17/42; F41A 35/06; F41A 19/00

USPC ..... 89/138

See application file for complete search history.

(56) References Cited

U.S. PATENT DOCUMENTS

| | | | | |
|---|---|---|---|---|
| 7,047,864 | B2 | 5/2006 | Spinner et al. | |
| 7,661,219 | B1 | 2/2010 | Knight, Jr. et al. | |
| D621,467 | S | 8/2010 | Montes | |
| 8,261,652 | B2 | 9/2012 | Findlay | |
| 8,359,966 | B1 | 1/2013 | Brotherton | |
| D686,686 | S | 7/2013 | Dueck | |
| D686,687 | S | 7/2013 | Dueck | |
| 8,984,786 | B2 | 3/2015 | Underwood | |
| 9,121,651 | B1 * | 9/2015 | Jen | F41A 17/38 |
| D760,862 | S | 7/2016 | Wang | |
| 9,417,020 | B2 | 8/2016 | McGinty | |
| D770,589 | S | 11/2016 | Underwood et al. | |
| 9,494,378 | B2 | 11/2016 | Gomez | |
| 9,541,339 | B2 * | 1/2017 | Orne, III | F41A 35/06 |
| 9,557,125 | B2 | 1/2017 | Stewart et al. | |
| 9,599,419 | B2 | 3/2017 | McGinty | |

(Continued)

FOREIGN PATENT DOCUMENTS

| | | |
|---|---|---|
| WO | 2018067912 A1 | 4/2018 |
| WO | 2021116405 A1 | 6/2021 |

OTHER PUBLICATIONS

International Search Report for International Application No. PCT/US2024/021133; Mailing Date, Jul. 10, 2024.

(Continued)

*Primary Examiner* — John Cooper

(74) *Attorney, Agent, or Firm* — CANTOR COLBURN LLP

(57) ABSTRACT

An ambidextrous bolt catch for use with a firearm, including: a bolt catch; a first lever operably coupled to the bolt catch via a connecting pin, wherein movement of the bolt catch causes movement of the first lever and movement of the first lever causes movement of the bolt catch; and a second lever pivotally mounted to the first lever.

20 Claims, 19 Drawing Sheets

(56) References Cited

U.S. PATENT DOCUMENTS

| | | | | |
|---|---|---|---|---|
| D784,478 | S | 4/2017 | Therrell | |
| D787,006 | S | 5/2017 | Sapio et al. | |
| 9,651,328 | B1 * | 5/2017 | Oglesby | F41A 35/06 |
| D797,878 | S | 9/2017 | Wang | |
| D805,155 | S | 12/2017 | Geissele | |
| D816,180 | S | 4/2018 | Farris et al. | |
| 9,958,223 | B1 | 5/2018 | McGinty | |
| 10,113,819 | B2 | 10/2018 | Stewart et al. | |
| D833,560 | S | 11/2018 | Underwood | |
| 10,197,353 | B2 * | 2/2019 | Lewis | F41A 3/68 |
| 10,215,513 | B2 | 2/2019 | Cross | |
| 10,228,201 | B2 * | 3/2019 | Walther | F41A 35/06 |
| 10,393,468 | B2 | 8/2019 | Maugham | |
| D859,567 | S | 9/2019 | Geissele | |
| D859,568 | S | 9/2019 | Geissele | |
| D859,569 | S | 9/2019 | Geissele | |
| D859,570 | S | 9/2019 | Geissele | |
| 10,508,874 | B2 | 12/2019 | Headrick et al. | |
| D892,961 | S | 8/2020 | Sugg | |
| 10,753,696 | B1 | 8/2020 | Christopher et al. | |
| 10,816,295 | B1 | 10/2020 | Oglesby | |
| 10,955,208 | B2 | 3/2021 | Headrick et al. | |
| 11,175,108 | B1 | 11/2021 | Lee et al. | |
| 11,512,920 | B1 | 11/2022 | Oglesby | |
| 11,536,531 | B1 * | 12/2022 | Geissele | F41A 35/02 |
| 2015/0323271 | A1 | 11/2015 | McGinty | |
| 2016/0258696 | A1 | 9/2016 | Fluhr et al. | |
| 2018/0372441 | A1 | 12/2018 | Zheng | |
| 2023/0003482 | A1 | 1/2023 | Markut et al. | |

OTHER PUBLICATIONS

Written Opinion for International Application No. PCT/US2024/021133; Mailing Date, Jul. 10, 2024.

* cited by examiner

AMBIDEXTROUS BOLT CATCH FOR USE WITH A FIREARM

TECHNICAL FIELD

Various embodiments of the present disclosure relate generally to firearms and more particularly, an ambidextrous bolt catch for use with a firearm.

BACKGROUND

In manual as well as semi, burst mode and fully automatic firearms, a bolt moves rearward and forward as each round is fired due to recoil or expanding gas and/or a buffer spring. The forward movement of the bolt moves a cartridge from a magazine into a chamber of the firearm. During rearward movement the bolt causes the spent ammunition casing to be removed from the chamber and ejected from the firearm. After the last round in the magazine is fired, a floor plate of the magazine is pushed upward by spring action to contact and lift a bolt catch that is pivotally mounted to the lower receiver of the firearm. In the lifted position, the bolt catch will prevent forward movement of the bolt and hold the bolt rearward of the magazine. Subsequently and after a full magazine is inserted into the firearm, the bolt must be allowed to move forward to chamber a new round of ammunition. In order to allow this, the bolt catch must be moved from its blocking position.

Various rifles known by the designations "M16" or "M4" or "M5" or "AR15" include a bolt catch that operates in the above manner. These rifles include a bolt catch that is pivotably secured to the firearm and is rotated or moved upward to block forward travel of the bolt as discussed above. After a new full magazine is inserted, the bolt catch is manually rotated downward to allow the bolt to move forward under spring biasing to chamber a round from the magazine. On these firearms, access to the bolt catch for movement of the bolt catch is typically located on only one side (e.g., the left side) of the firearm.

Accordingly, it desired to provide a firearm with a bolt catch that is operable from both sides of the firearm.

BRIEF SUMMARY

Disclosed is an ambidextrous bolt catch for use with a firearm, including: a bolt catch; a first lever operably coupled to the bolt catch via a connecting pin, wherein movement of the bolt catch causes movement of the first lever and movement of the first lever causes movement of the bolt catch; and a second lever pivotally mounted to the first lever, the second lever being moveably received within an opening of the first lever.

In addition to one or more of the features described above, or as an alternative to any of the foregoing embodiments, the connecting pin is secured to the bolt catch at one end of the connecting pin and an opposite end of the connecting pin is secured to the first lever.

Also disclosed is an ambidextrous bolt catch for use with a lower receiver of a firearm, including: a bolt catch pivotally mounted to the lower receiver for movement between a first position and a second position with respect to the lower receiver; a first lever operably coupled to the bolt catch via a connecting pin, the first lever being pivotally mounted to the lower receiver for movement between a first position and a second position with respect to the lower receiver; and a second lever pivotally mounted to the first lever for movement between a first position and a second position with respect to the first lever, wherein movement of the bolt catch between the first position and the second position causes movement of the first lever between the first position and the second position and movement of the first lever between the first position and the second position causes movement of the bolt catch between the first position and the second position.

In addition to one or more of the features described above, or as an alternative to any of the foregoing embodiments, movement of the bolt catch from the first position to the second position causes a portion of the bolt catch to move outwardly from a groove in the lower receiver.

In addition to one or more of the features described above, or as an alternative to any of the foregoing embodiments, the bolt catch further includes a blocking portion positioned to block forward movement of a bolt, when the bolt catch is in the second position.

In addition to one or more of the features described above, or as an alternative to any of the foregoing embodiments, the bolt is secured to a bolt carrier movably received within an upper receiver secured to the lower receiver and the second lever is moveably received within an opening of the first lever.

In addition to one or more of the features described above, or as an alternative to any of the foregoing embodiments, movement of the second lever from the first position to the second position causes the first lever to move from the first position to the second position.

In addition to one or more of the features described above, or as an alternative to any of the foregoing embodiments, the second lever has a protrusion configured to contact the lower receiver when the second lever is moved from the first position to the second position.

In addition to one or more of the features described above, or as an alternative to any of the foregoing embodiments, the bolt catch rotates in a first plane and the first lever and the second lever rotate in a second plane, the first plane being orthogonal to the second plane.

In addition to one or more of the features described above, or as an alternative to any of the foregoing embodiments, the bolt catch is pivotally mounted to the lower receiver via a first pin and the first lever is pivotally mounted to the lower receiver via a second pin, the first pin being orthogonal to the second pin.

In addition to one or more of the features described above, or as an alternative to any of the foregoing embodiments, a spring is located on the connecting pin and the spring is configured to contact a flange portion of the connecting pin at one end and a flange portion of a first opening in the lower receiver, the first opening being connected to a second opening in the lower receiver, the second opening being smaller than the first opening and the connecting pin extending through both the first opening and the second opening, the first opening and the second opening extending across the lower receiver from a right side of the lower receiver to a left side of the lower receiver.

In addition to one or more of the features described above, or as an alternative to any of the foregoing embodiments, the spring provides a biasing force to urge the bolt catch from the second position to the first position.

In addition to one or more of the features described above, or as an alternative to any of the foregoing embodiments, the spring provides a biasing force to urge the first lever from the second position to the first position.

In addition to one or more of the features described above, or as an alternative to any of the foregoing embodiments, the bolt catch is pivotally mounted to a first side of the lower receiver and the first lever is pivotally mounted to a second side of the lower receiver, the first side of the lower receiver being opposite to the second side of the lower receiver.

In addition to one or more of the features described above, or as an alternative to any of the foregoing embodiments, the first side of the lower receiver is a left side of the lower receiver and the second side of the lower receiver is a right side of the lower receiver.

In addition to one or more of the features described above, or as an alternative to any of the foregoing embodiments, the connecting pin is secured to first lever via a ball portion received in a socket.

In addition to one or more of the features described above, or as an alternative to any of the foregoing embodiments, the bolt catch includes a planar portion that is engageable from a side of the lower receiver in order to move the bolt catch from the second position to the first position.

In addition to one or more of the features described above, or as an alternative to any of the foregoing embodiments, the bolt catch and the first lever are spring biased into the first position by a single spring.

Also disclosed is a method for releasing a bolt via an ambidextrous bolt catch secured to a lower receiver of a firearm, including: pivoting a bolt catch pivotally mounted to the lower receiver from a second position to a first position in order to release the bolt being contacted by the bolt catch; pivoting a first lever pivotally mounted to the lower receiver from a second position to a first second position with respect to the lower receiver, the first lever being operably coupled to the bolt catch via a connecting pin; and pivoting a second lever pivotally mounted to the first lever from a second position to a first position, wherein movement of the bolt catch between the first position and the second position causes movement of the first lever between the first position and the second position and movement of the first lever between the first position and the second position causes movement of the bolt catch between the first position and the second position.

In addition to one or more of the features described above, or as an alternative to any of the foregoing embodiments, movement of the bolt catch from the first position to the second position causes a portion of the bolt catch to move outwardly from a groove in the lower receiver.

BRIEF DESCRIPTION OF THE DRAWINGS

Embodiments of the invention will now be described, by way of example only, with reference to the attached Figures, wherein.

DETAILED DESCRIPTION

Referring now to the FIGS., an ambidextrous bolt catch 10 in accordance with various embodiments of the present disclosure is illustrated. The ambidextrous bolt catch 10 is intend for use with a firearm in particular an automatic or semi-automatic firearm capable of automatic or semiautomatic fire incorporating features in accordance with an exemplary embodiments of the present disclosure. Although the features of such embodiments will be described with reference to the embodiments shown in the attached FIGS., it should be understood that the described features can be embodied in many alternate forms of embodiments. In addition, any suitable size, shape or type of elements or materials could be used.

Figure 1:
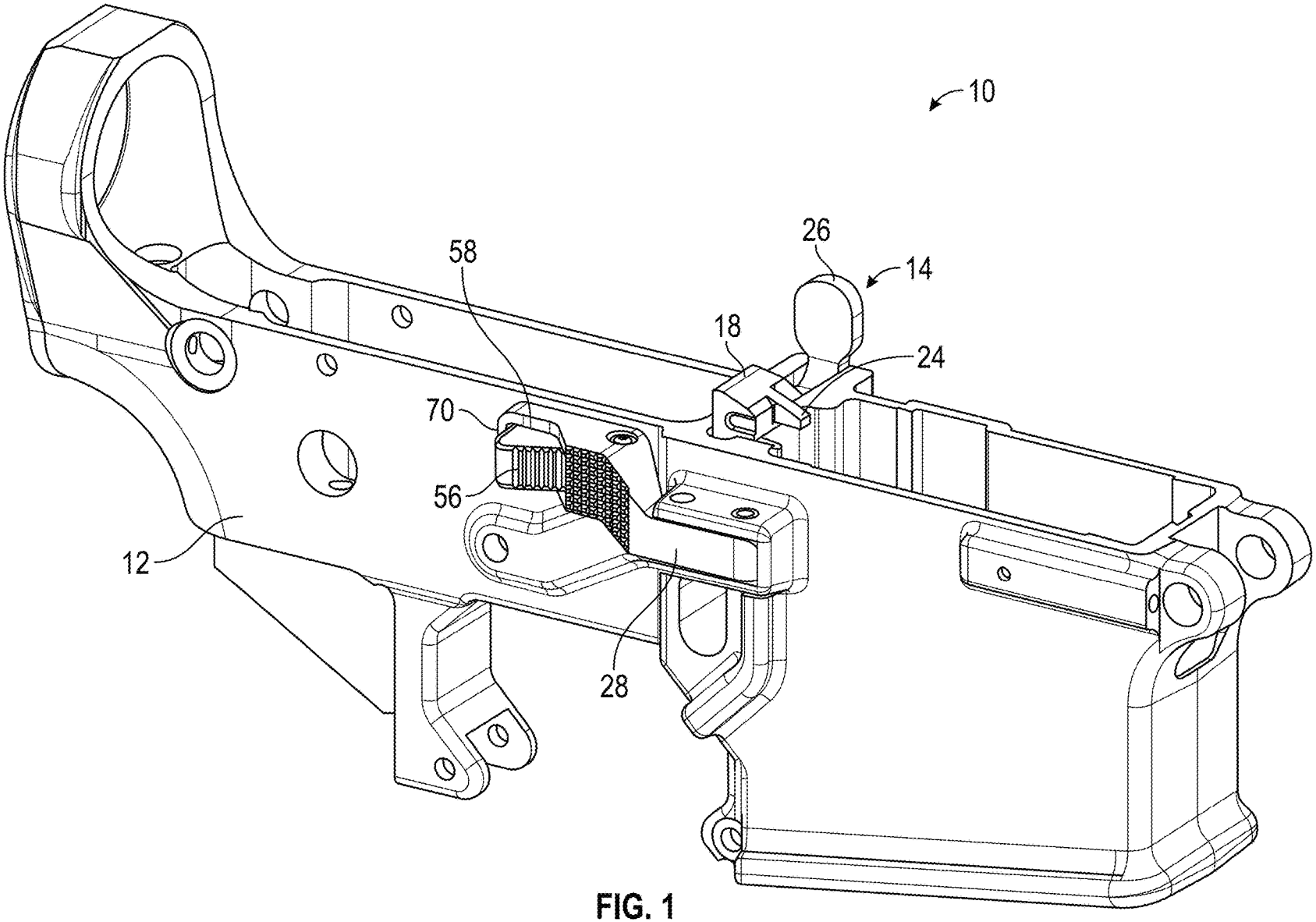
FIG. 1 is a perspective view of a lower receiver with an ambidextrous bolt catch in accordance with the present disclosure.
Figure 2:
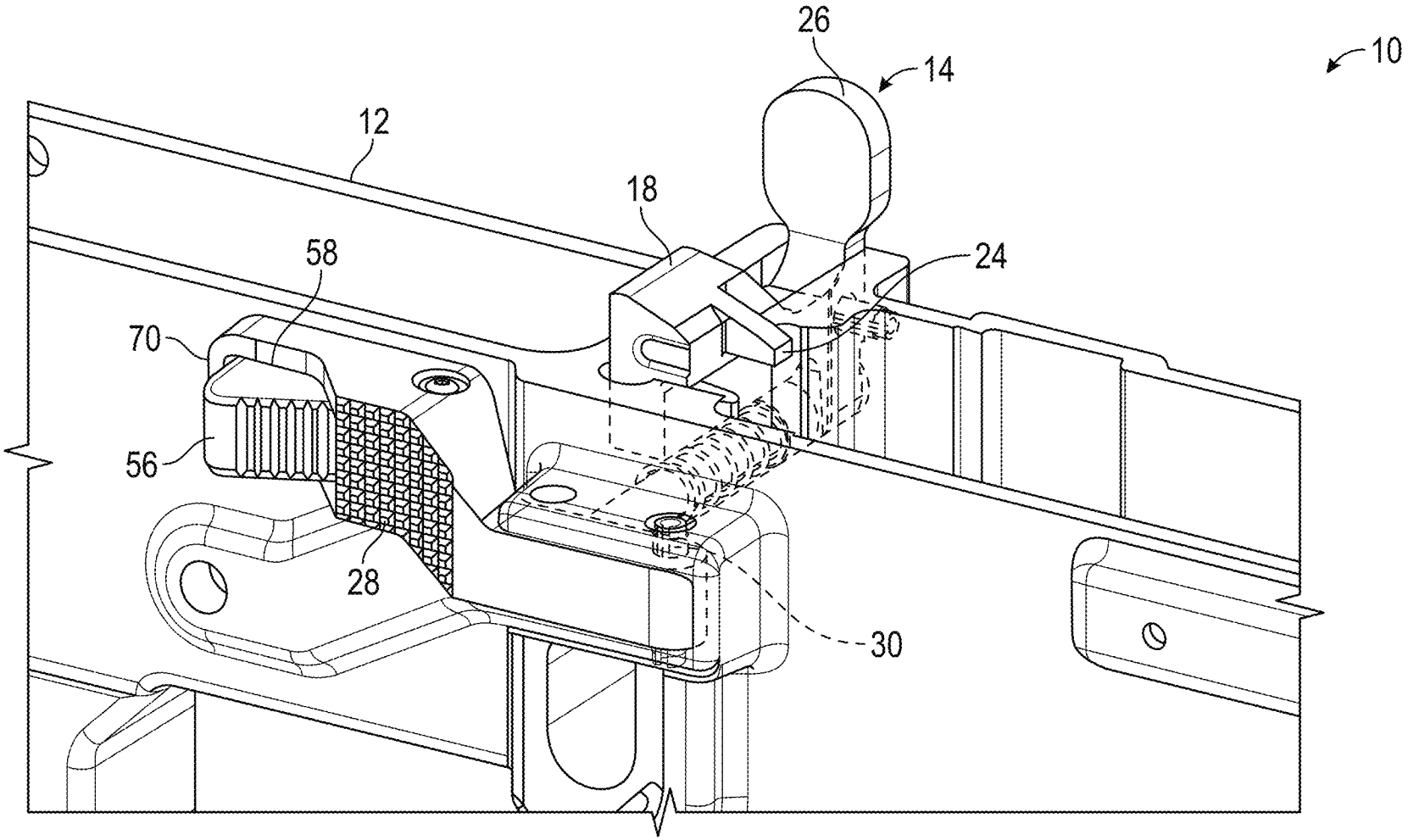
FIG. 2 is a perspective view of a portion of the lower receiver illustrated in FIG. 1 with an ambidextrous bolt catch in accordance with the present disclosure.
Figure 3:
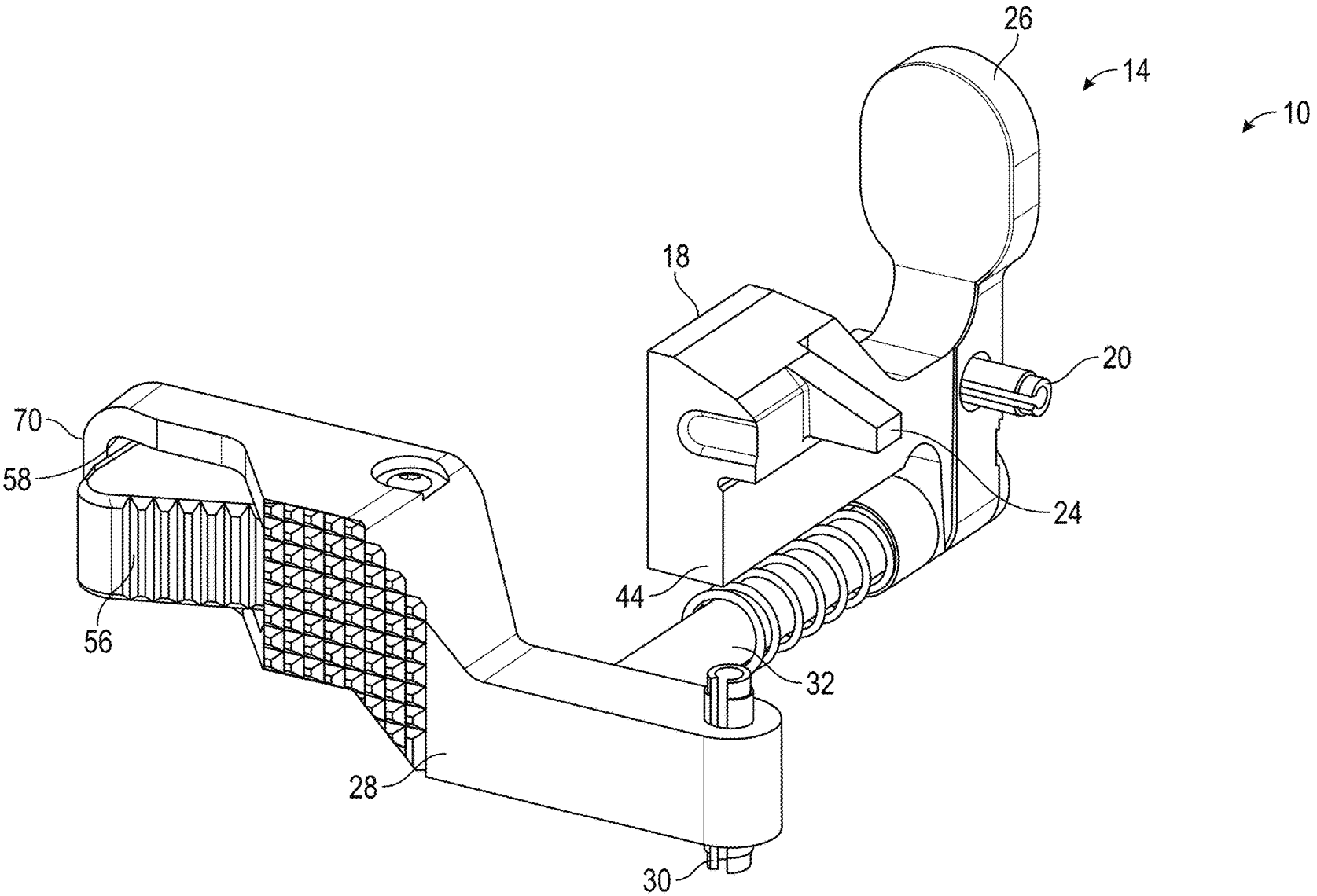
FIG. 3 is a perspective view of an ambidextrous bolt catch in accordance with the present disclosure.
Figure 4:
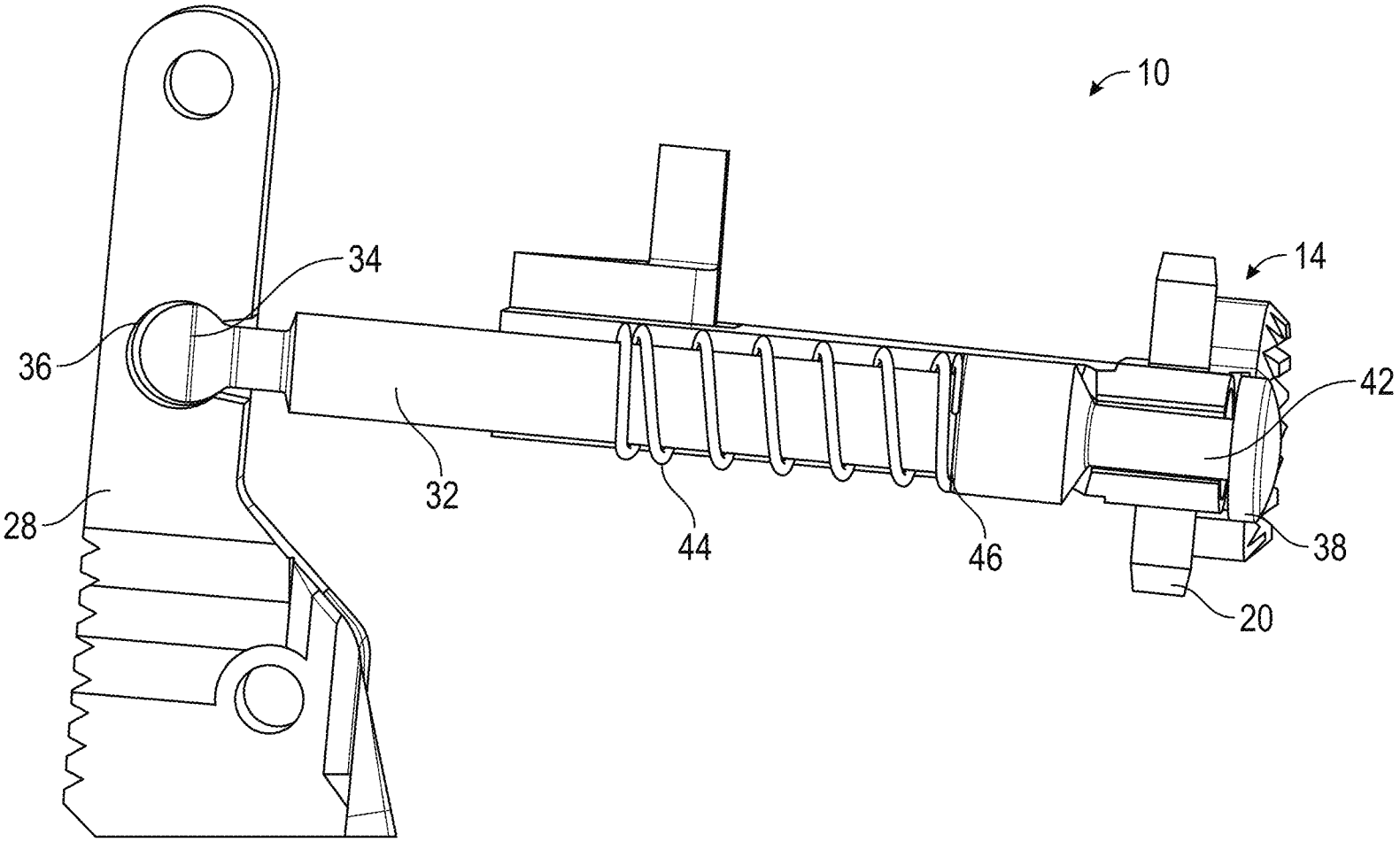
FIG. 4 is another perspective view of an ambidextrous bolt catch in accordance with the present disclosure.
Figure 5:
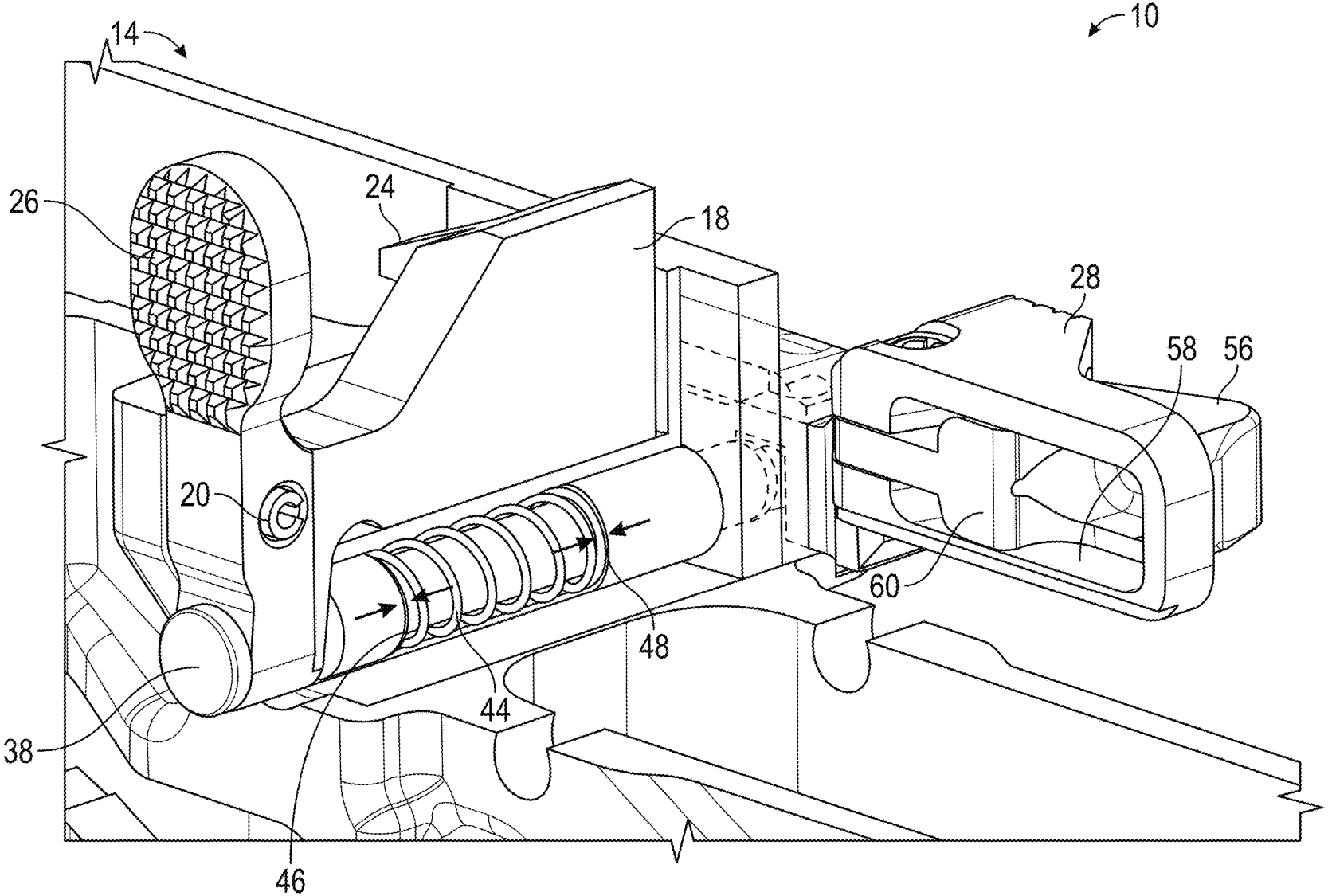
FIG. 5 is a perspective view of a portion of the lower receiver illustrated in FIG. 1 with an ambidextrous bolt catch in accordance with the present disclosure.
Figure 6:
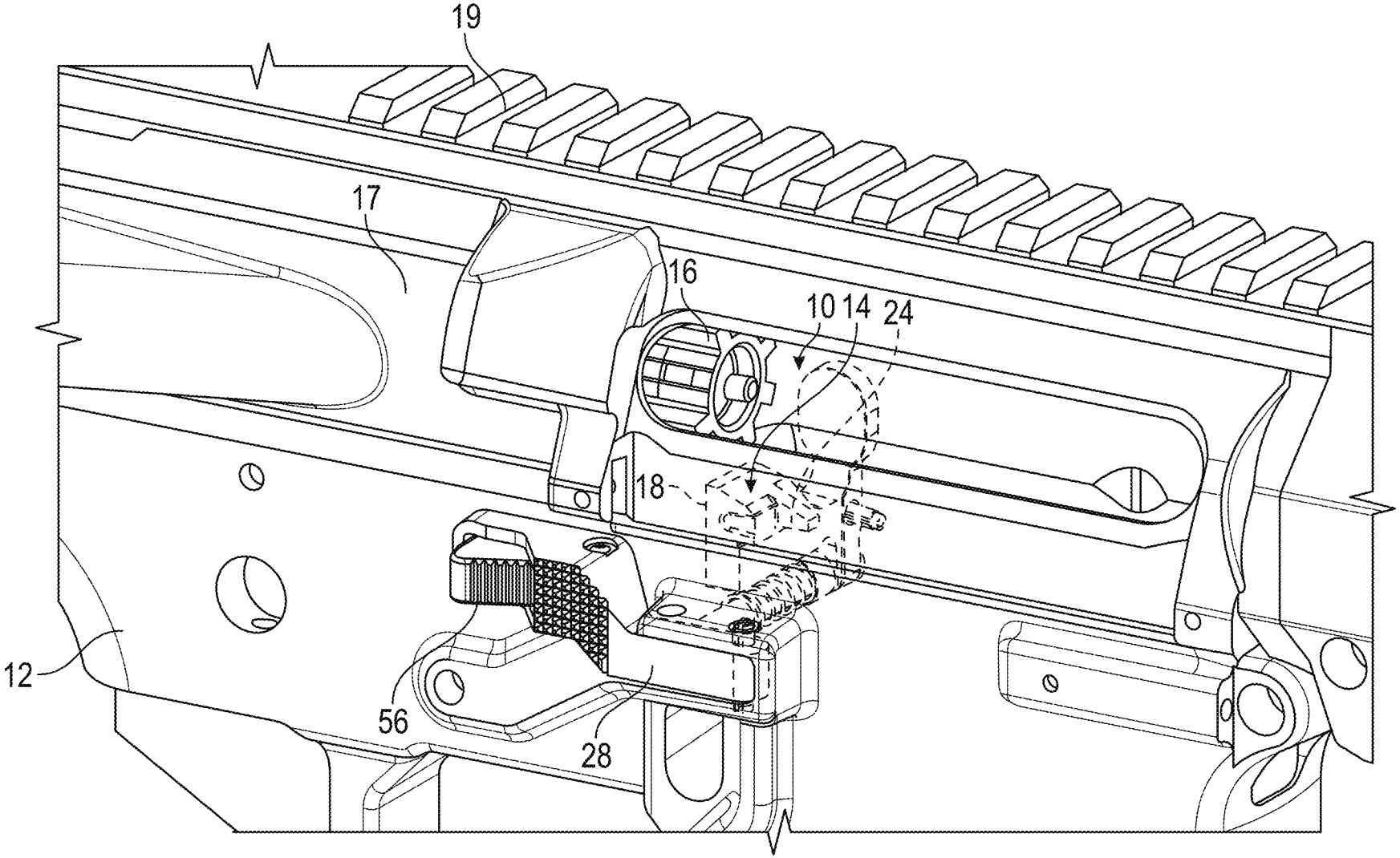
FIG. 6 is a perspective view of a portion of the lower receiver illustrated in FIG. 1 and an upper receiver with an ambidextrous bolt catch in accordance with the present disclosure.
Figure 7:
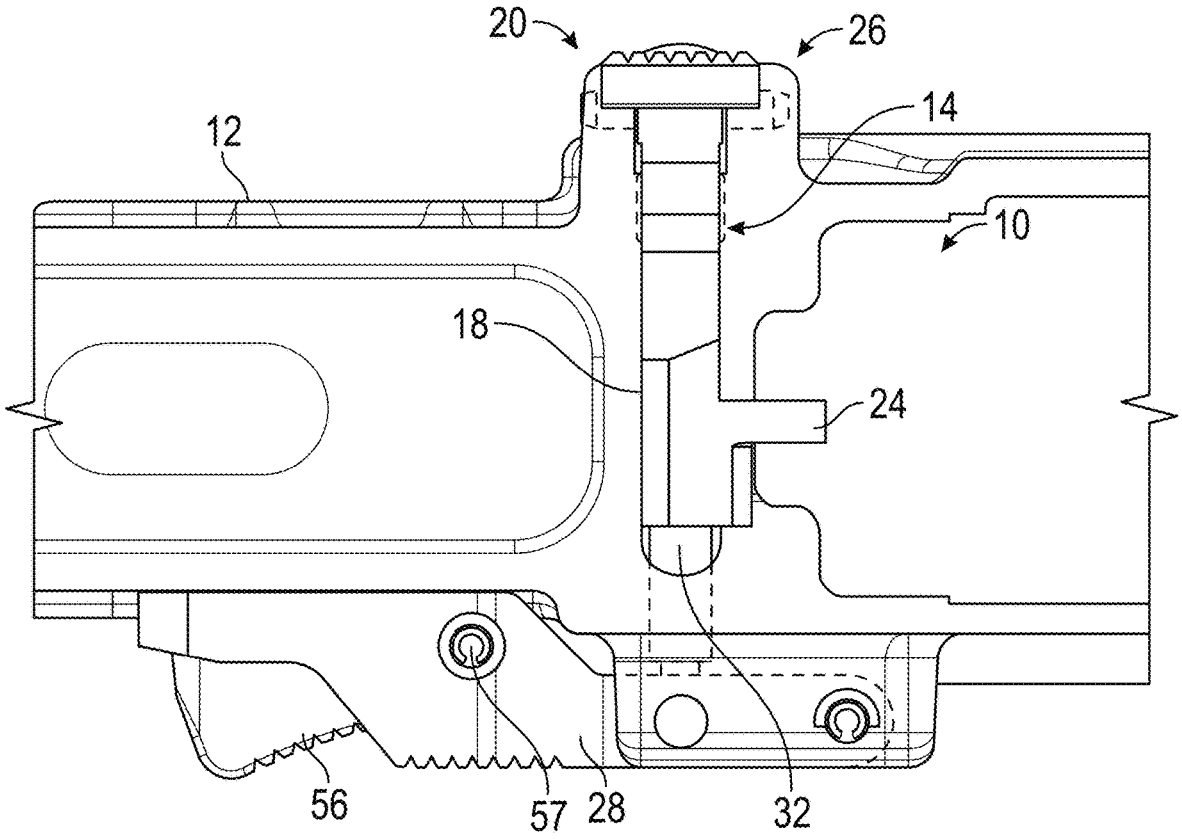
FIG. 7 is a top view of a portion of the lower receiver illustrated in FIG. 1 with an ambidextrous bolt catch in accordance with the present disclosure.
Figure 8:
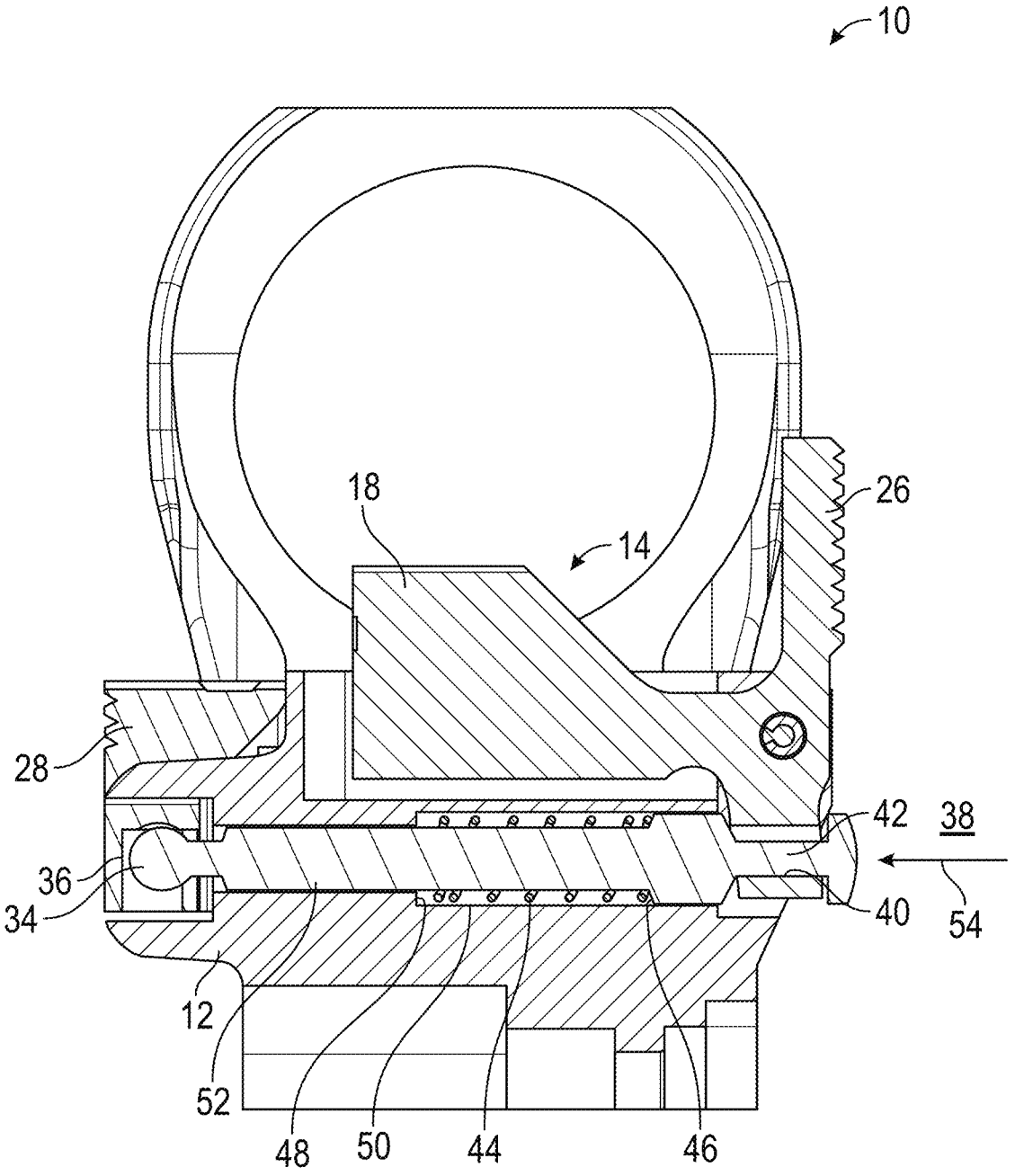
FIG. 8 is a cross-sectional view of the lower receiver illustrated in FIG. 1 with an ambidextrous bolt catch in accordance with the present disclosure in a first position.
Figure 9:
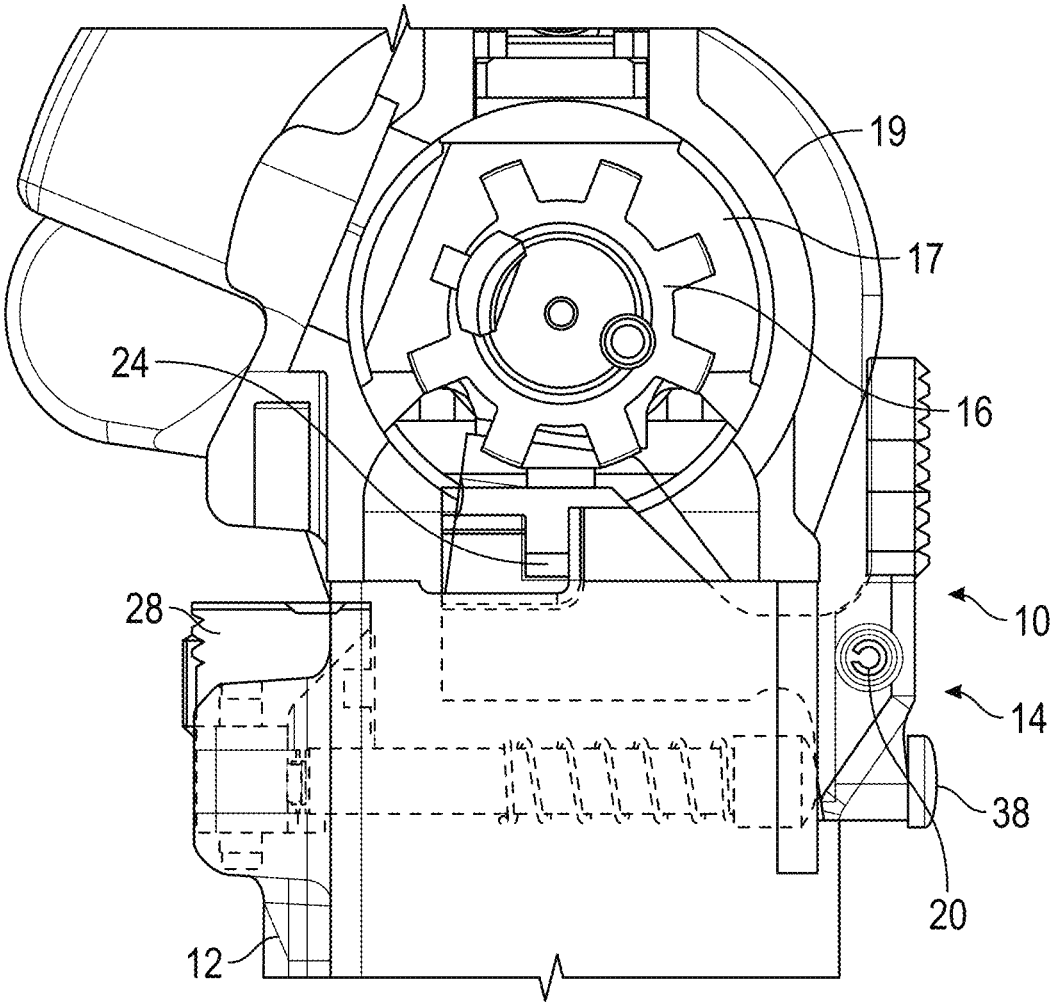
FIG. 9 is a front end view of the lower receiver and upper receiver with an ambidextrous bolt catch in accordance with the present disclosure in a first position.
Figure 10:
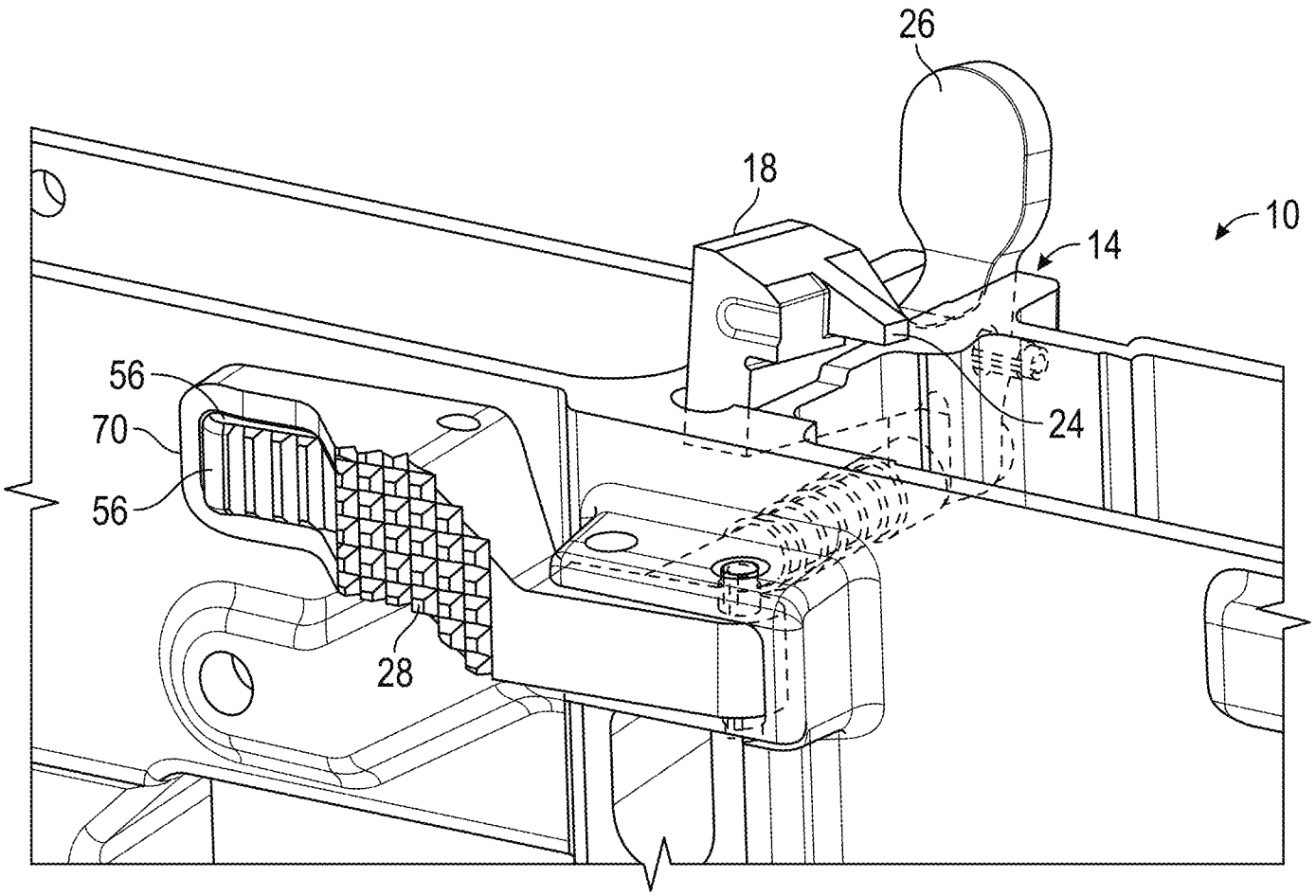
FIG. 10 is a perspective view of a portion of the lower receiver illustrated in FIG. 1 with an ambidextrous bolt catch in accordance with the present disclosure in a second position.
Figure 11:
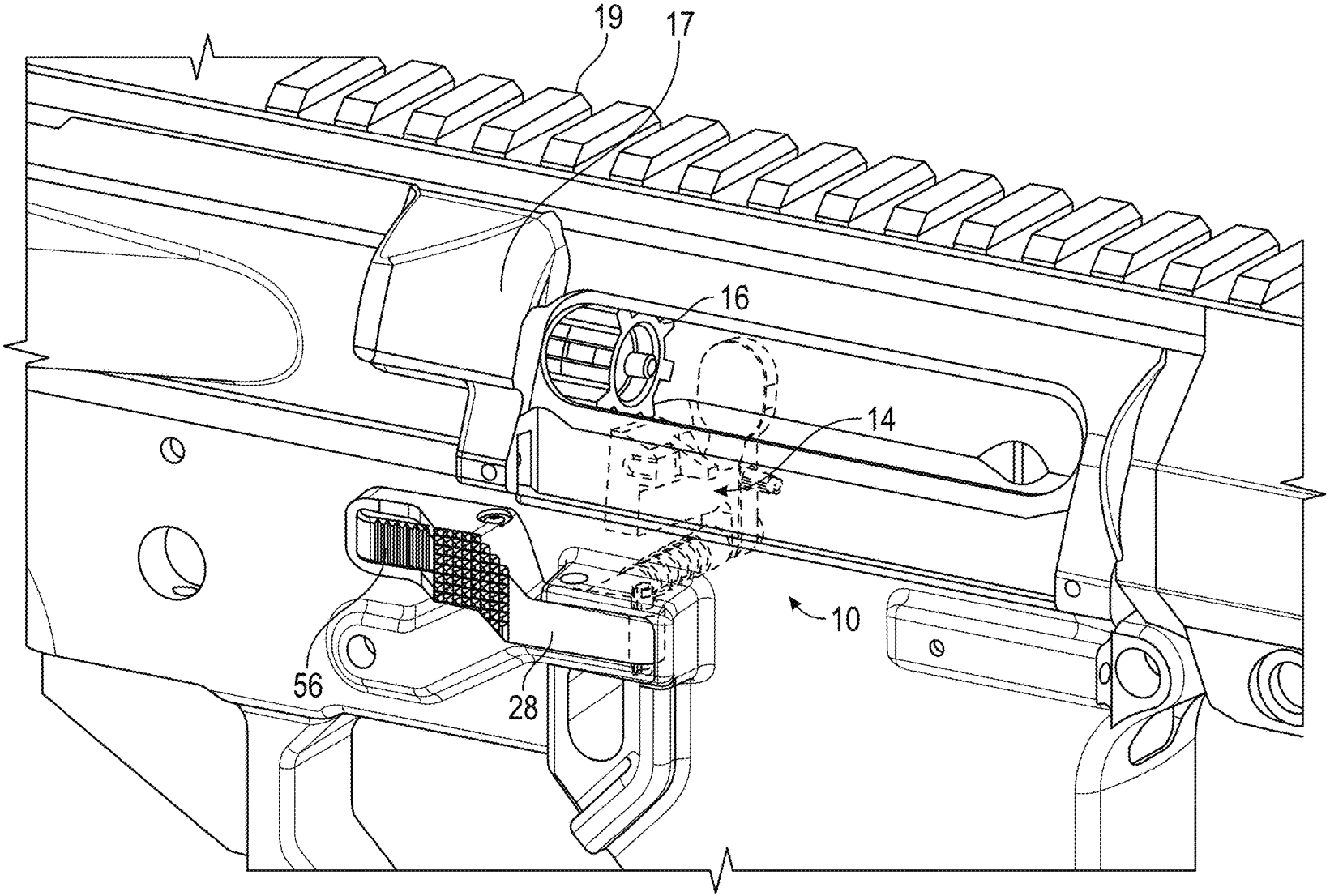
FIG. 11 is a perspective view of a portion of the lower receiver illustrated in FIG. 1 and an upper receiver with an ambidextrous bolt catch in accordance with the present disclosure in a second position.
Figure 12:
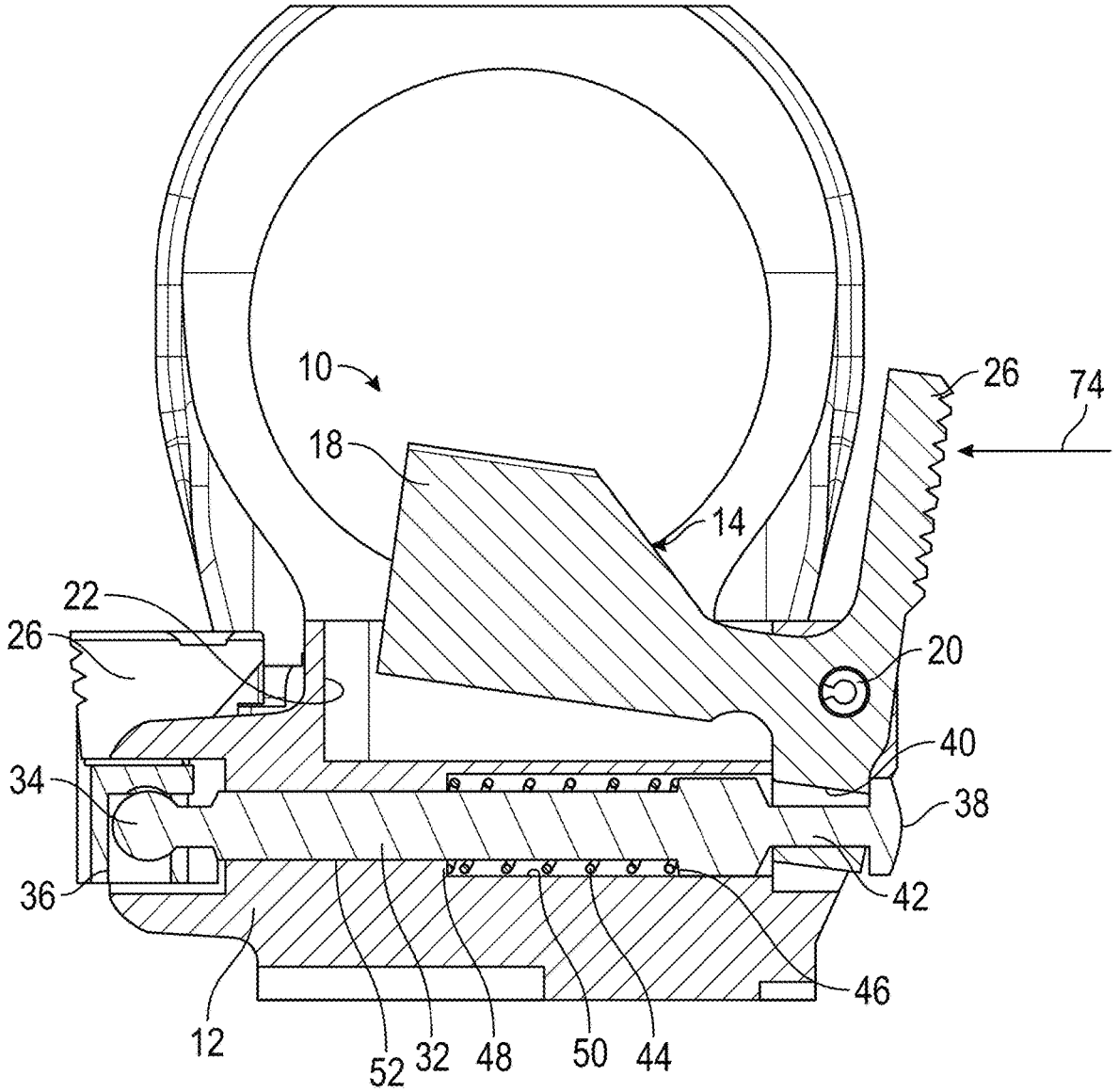
FIG. 12 is a cross-sectional view of the lower receiver illustrated in FIG. 1 with an ambidextrous bolt catch in accordance with the present disclosure in a second position.
Figure 13:
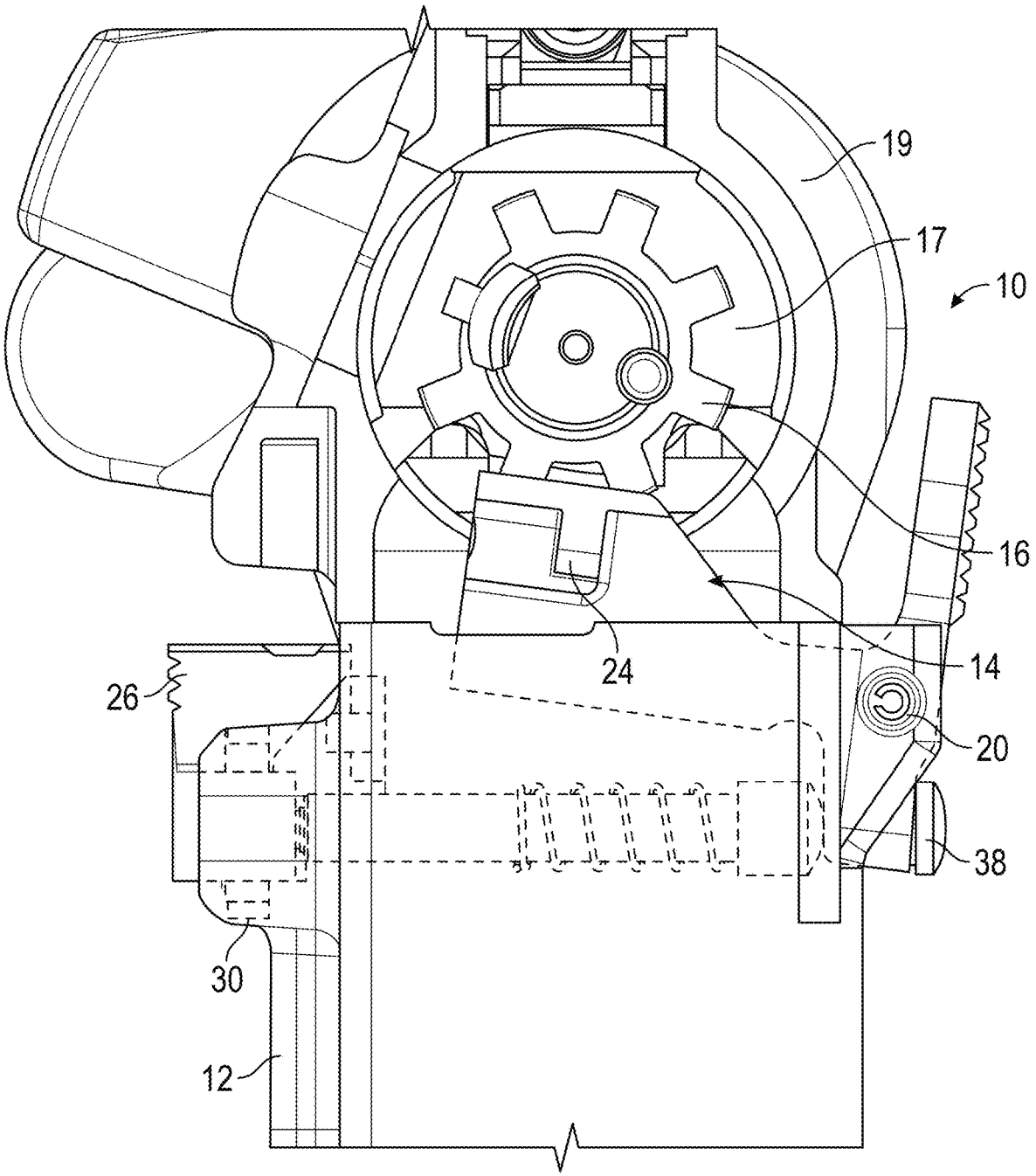
FIG. 13 is a front end view of the lower receiver and upper receiver with an ambidextrous bolt catch in accordance with the present disclosure in a second position.
Figure 14:
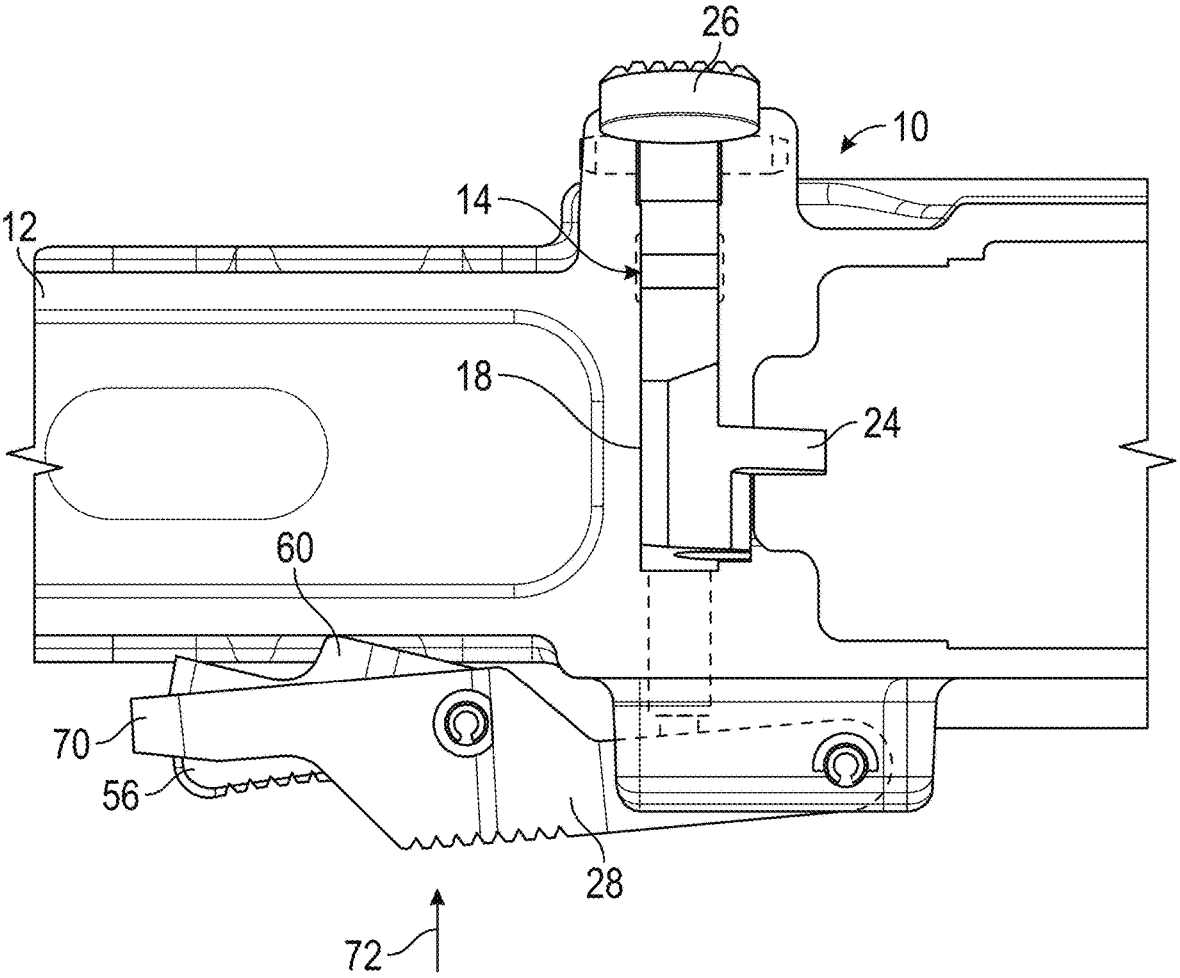
FIG. 14 is a top view of a portion of the lower receiver illustrated in FIG. 1 with an ambidextrous bolt catch in accordance with the present disclosure in a second position.
Figure 15:
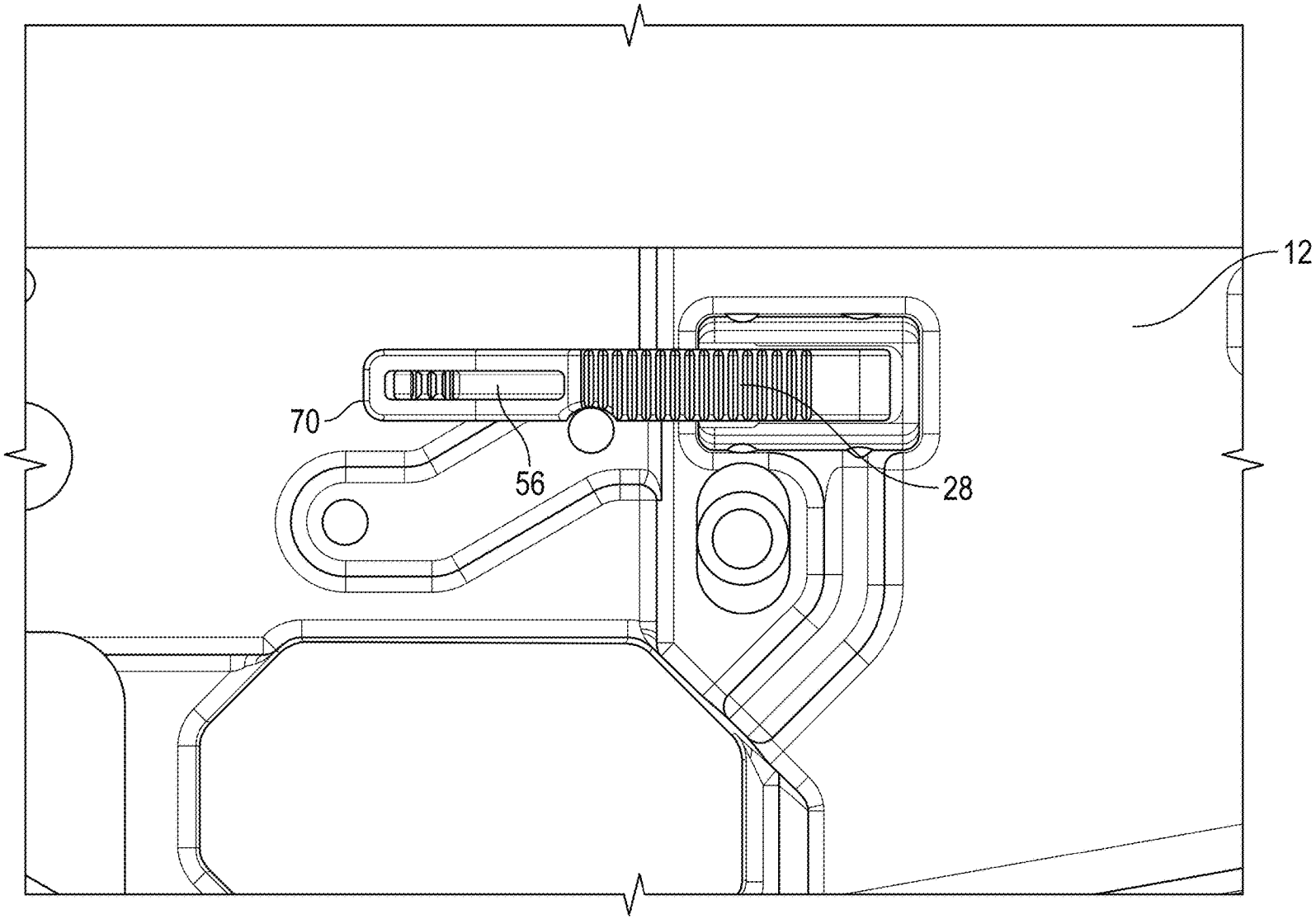
FIG. 15 is a side view of a portion of the lower receiver illustrated in FIG. 1 with an ambidextrous bolt catch in accordance with another embodiment of the present disclosure.
Figure 16:
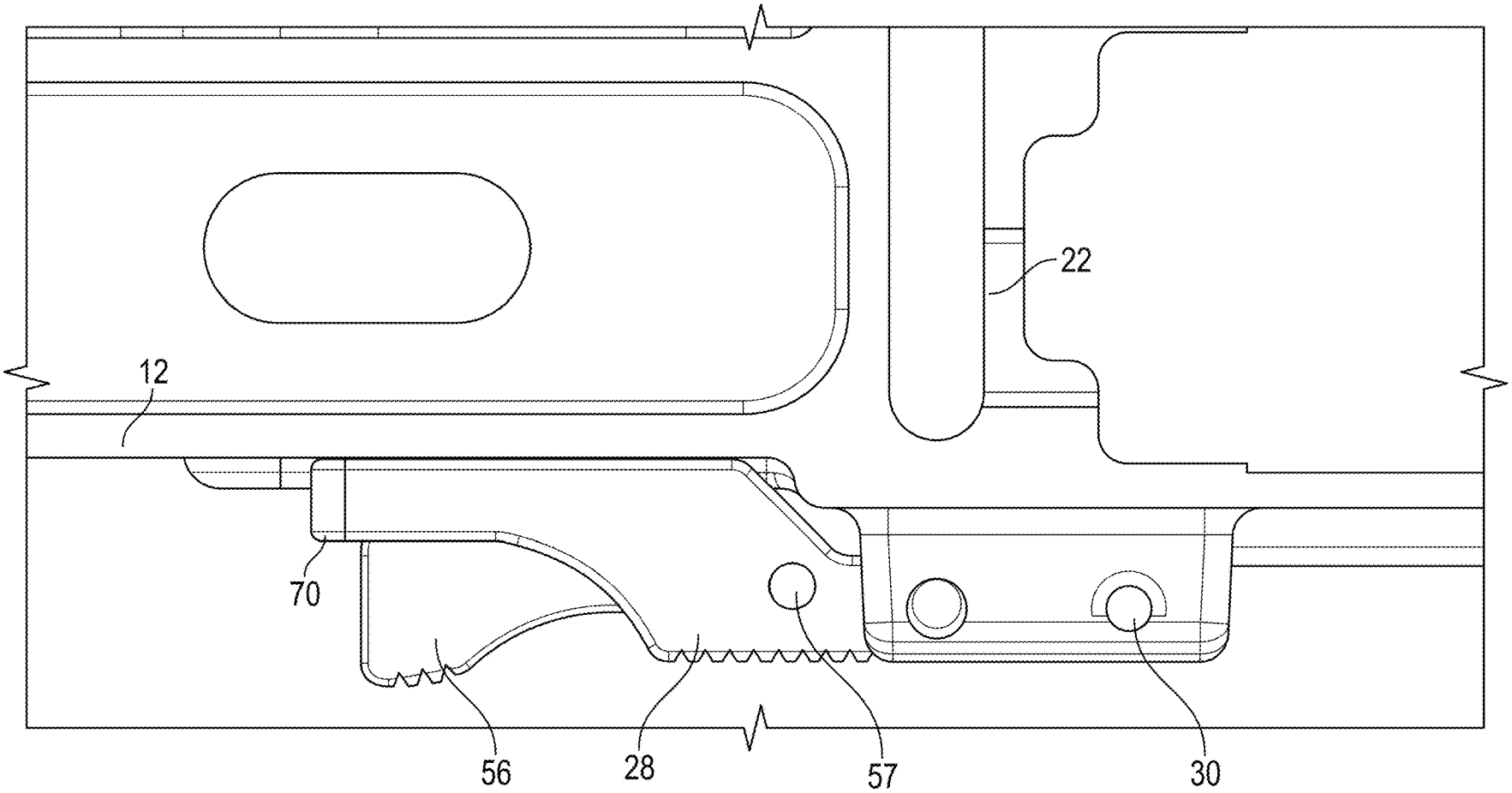
FIG. 16 is a top view of a portion of the lower receiver illustrated in FIG. 1 with an ambidextrous bolt catch in accordance with another embodiment of the present disclosure in a first position.
Figure 17:
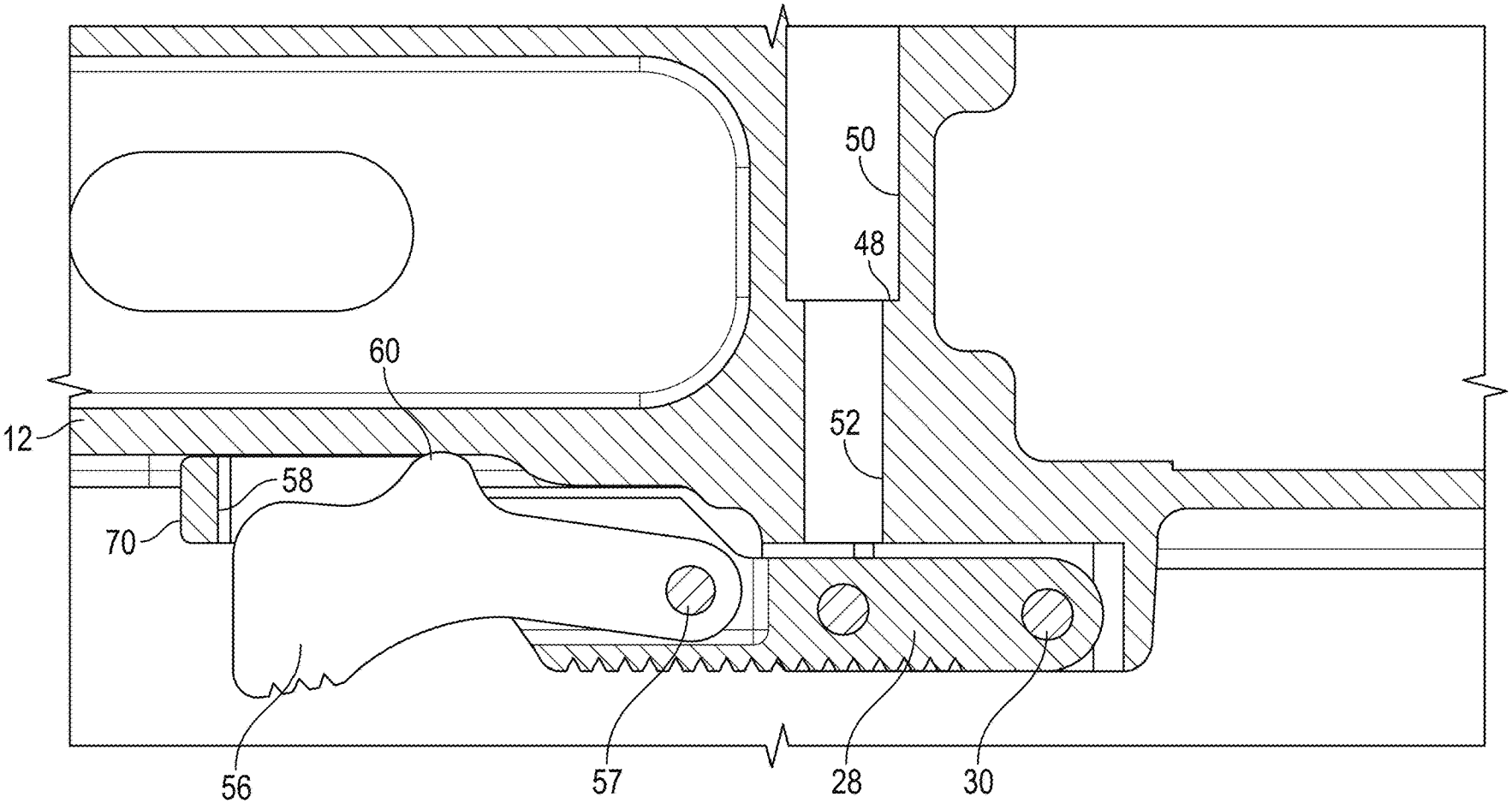
FIG. 17 is a top cross-section view of a portion of the lower receiver illustrated in FIG. 1 with an ambidextrous bolt catch in accordance with another embodiment of the present disclosure in a first position.
Figure 18:
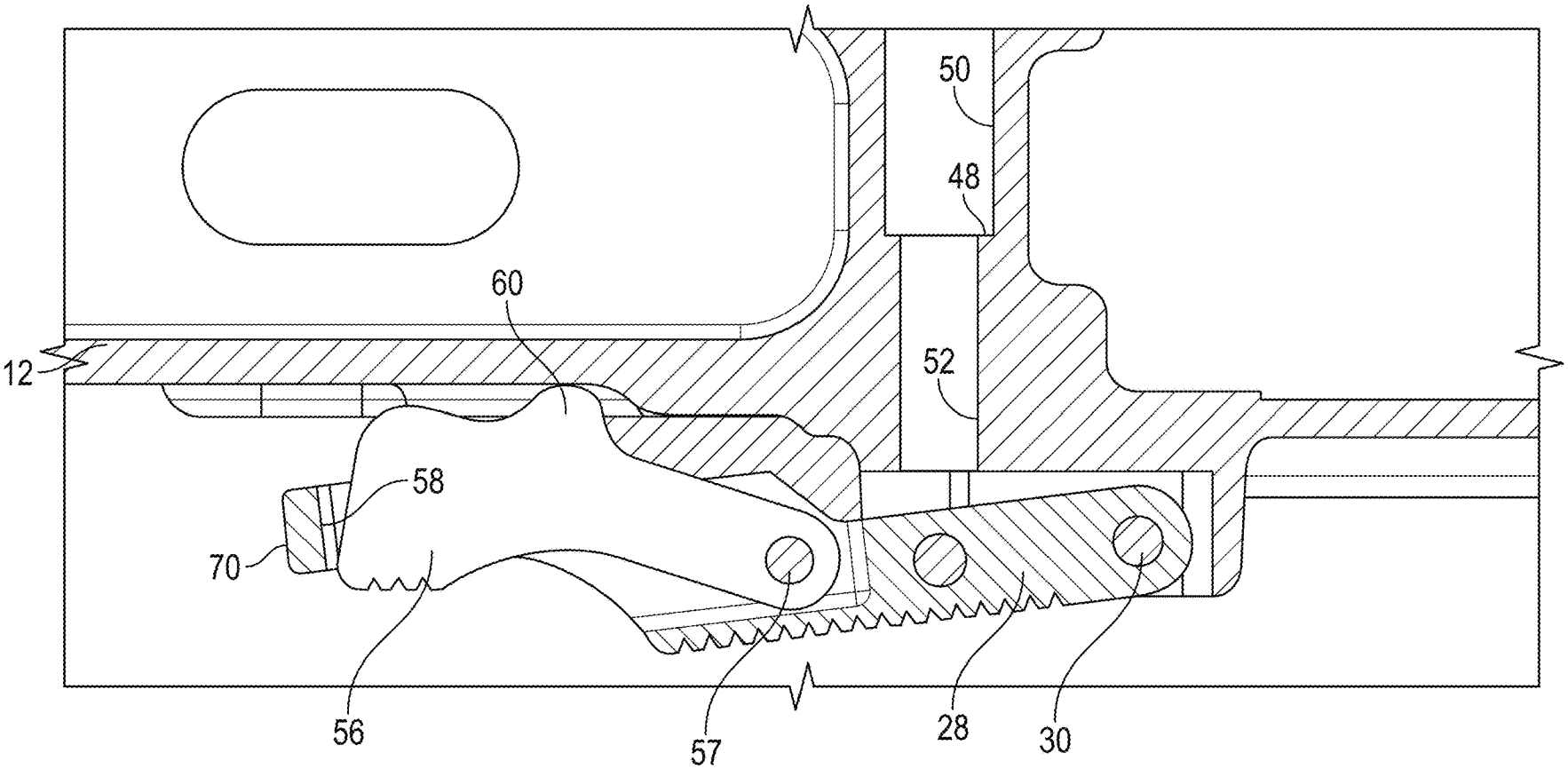
FIG. 18 is a top cross-section view of a portion of the lower receiver illustrated in FIG. 1 with an ambidextrous bolt catch in accordance with another embodiment of the present disclosure in a second position.

Referring now to at least FIG. 1, a perspective view of a lower receiver 12 with the ambidextrous bolt catch 10 in accordance with the present disclosure is illustrated. As used herein ambidextrous bolt catch is intended to refer to a bolt catch that is actuatable from opposite sides of the firearm or in other words left and right sides of the firearm.

As used herein, the terms "right" and "left" refer to the relative locations or directions with respect to a user holding an associated firearm in conventional manner for firing. The term "forward" and "rearward" refer to the relative locations or directions with respect to a user holding an associated firearm in conventional manner for firing.

Operation of a bolt catch with M16/M4/M5 rifles is well known and understood. As mentioned above, a bolt of a firearm moves rearward and forward within the firearm in order to perform various functions. Still further and in certain circumstances it is desirable to restrict movement of the bolt forward by engaging it with a bolt catch.

Referring now to FIGS. 1-19, an ambidextrous bolt catch 10 is provided in accordance with various embodiments of the present disclosure. The ambidextrous bolt catch 10 can be moved into a blocking or unblocking position from either side of the firearm. As illustrated, the ambidextrous bolt catch 10 includes a bolt catch 14 pivotally mounted to the lower receiver 12 for movement between a first or non-blocking position and a second or blocking position. When the bolt catch 14 is in the first or non-blocking position the bolt catch 14 does not block forward movement of a bolt 16 (see at least FIGS. 1, 2, and 5-9) and when the bolt catch 14 is in the second or blocking position a blocking portion 18 of the bolt catch 14 is in a position to block forward movement of the bolt 16 (see at least FIGS. 10-14). As illustrated and as is known in the related arts, the bolt 16 is secured to a bolt carrier 17. The bolt carrier being movably received within an upper receiver 19. The upper receiver 19 being secured to the lower receiver 12.

The bolt catch 14 is pivotally mounted to the lower receiver 12 via a pin 20 for the aforementioned movement between the first or non-blocking position and the second or blocking position. As illustrated in at least FIG. 8, the lower receiver 12 has a groove 22 wherein portions of the bolt catch 14 are received for the aforementioned movement between the first or non-blocking position and the second or blocking position. The bolt catch 14 also includes a contact portion 24 for engaging a plate of a magazine (not shown) to move the bolt catch 14 into the second or blocking position.

The bolt catch 14 also includes a planar portion 26 that is engageable from a side of the lower receiver 12 in order to move the bolt catch 14 from the second or blocking position to the first or non-blocking position.

The ambidextrous bolt catch 10 includes a first lever 28 that is also pivotally mounted to the lower receiver 12 via a pin 30. In one non-limiting exemplary embodiment, the axis of pin 20 is orthogonal to the axis of pin 30. In other words, the bolt catch 14 rotates in a plane orthogonal to a plane in which the first lever 28 rotates. It being understood that other orientations of the axis of pin 20 and pin 30 with respect to each other (e.g., non-orthogonal) are considered to be within the scope of the present disclosure as long as they are in different non-parallel planes with respect to each other. As illustrated, the first lever 28 is pivotally mounted to the lower receiver 12 for actuation on one side of the lower receiver 12 and the planar portion 26 and other portions of the bolt catch 10 are mounted to the lower receiver 12 for actuation on an opposite side of the lower receiver 12. In accordance with one embodiment, the first lever 28 is pivotally mounted to a right side of the lower receiver 12 and the planar portion 26 and other portions of the bolt catch 10 are mounted to the lower receiver 12 for actuation on the left side of the lower receiver 12.

The first lever 28 is operably coupled to the bolt catch 14 via a connecting pin or member 32. The connecting pin or member 32 is secured to first lever 28 via a ball portion 34 received in a socket 36. At an opposite end a head portion 38 of the connecting pin or member 32 prevents the connecting pin or member 32 from passing through an opening 40 in the bolt catch 14. The head portion 38 being formed on a portion 42 of the connecting pin or member 32 after the portion 42 is passed through opening 40 in the bolt catch 14. Of course, other types of securement of the connecting pin or member 32 to the first lever 28 and the bolt catch 14 are contemplated.

In order to provide a biasing force to the ambidextrous bolt catch 10, a spring 44 is located on the connecting pin or member 32, the spring 44 is configured to contact a flange portion 46 of the connecting pin or member 32 at one end and a flange portion 48 of a first opening 50 in the lower receiver 12. The first opening 50 being connected to a second opening 52 in the lower receiver 12. The second opening 52 being smaller than the first opening 50 and the connecting pin or member 32 extending through both the first opening 50 and the second opening 52. The first opening 50 and the second opening 52 extending across the lower receiver from the right side to the left side.

When the bolt catch 14 is in the first or non-blocking position the spring 44 is not compressed and then the bolt catch 14 is in the second or blocking position, the spring 44 is compressed in order to provide a biasing force in order to assist in moving the bolt catch 14 from the second or blocking position to the first or non-blocking position. It being understood that frictional engagement of the blocking portion 18 of the bolt catch 14 with the bolt 16 is sufficient to prevent the bolt catch 14 from moving to the second or blocking position to the first or non-blocking position solely due to the biasing force of the spring 44. However, the biasing force of the spring 44 will assist in moving the bolt catch 14 into the first or non-blocking when a user applied force is applied to either the bolt catch 14 or the first lever 28.

As mentioned above, the bolt catch 14 is moved from the first or non-blocking position to the second or blocking position via contact portion 24 engaging a plate of a magazine (not shown) to move the bolt catch 14 into the second or blocking position. It is also possible to move the bolt catch 14 into the second or blocking position manually by applying a force in the direction of arrow 54 to head portion 38 or portions of the bolt catch 14 proximate to the head portion 38 in order to achieve the desired movement or by actuating a second lever 56 that is pivotally secured to the first lever 28.

The second lever 56 is pivotally secured to the first lever 28 via a pin 57 for movement between a first position and a second position. In one non-limiting embodiment, the axis of the pin 57 is parallel to the axis of the pin 30 such that the first lever 28 and the second lever 56 rotate in the same plane. In one non-limiting embodiment, the second lever 56 is moveably received within an opening 58 of the first lever 28 such that as the second lever 56 is moved from the first position to the second position a contact portion 60 of the second lever 56 will contact the lower receiver 12 and move the first lever 28 away from the lower receiver 12 by for example, moving the first lever 28 from a first position to a second position. The first position of the first lever 28 corresponding to the first or non-blocking position of the bolt catch 14 and the second position of the first lever 28 corresponding to the second or blocking position of the bolt catch 14. In an alternative embodiment, the first lever 28 does not have opening 58 and the second lever 56 is pivotally secured to the first lever 28 for movement between the first position and the second position in order to achieve the desired movement of the first lever 28. In other words and in this embodiment, the second lever 56 can move between the first position and the second position without having to pass though an opening 58 in the first lever 28.

In addition and as illustrated, when the first lever 28 is in the first position an end portion 70 of the first lever 28 is closer to the lower receiver 12 than when the first lever 28 is in the second position.

Since the first lever 28 is operably coupled to the bolt catch 14 via the connecting pin or member 32, movement of the first lever 28 away from the lower receiver 12 to the second position of the first lever 28 will move the bolt catch 14 from the first or non-blocking position to the second or blocking position. This may be useful when a user of the firearm wishes to hold the bolt 16 in a blocked position that is unrelated to a last round being chambered from a magazine. For example, the user may wish to inspect a chamber of a firearm that does not have a magazine loaded therein.

In order to move the bolt catch 14 from the second or blocking position to the first or non-blocking position a user can apply a force to the first lever 28 in the direction of arrow 72 to move the first lever from the second position to the first position or alternatively in the direction of arrow 74 to planar portion 26 in order to move the bolt catch from the second position to the first position. As such, ambidextrous bolt catch 10 is actuatable from either side of the lower receiver 12 in order to move the bolt catch 14 from the first or non-blocking position to the second or blocking position or to move the bolt catch 14 from the second or blocking position to the first or non-blocking position.

In addition and since contact portion 60 of the second lever contacts the lower receiver 12, movement of the first lever 28 from the second position to the first position will cause the second lever 56 to move from the second position to the first position.

In order to assist with application of forces to the first lever 28, the second lever 56 and the bolt catch 14, portions of the surfaces of the first lever 28, the second lever 56 and planar surface 26 are provided with friction enhancing features such as but not limited to a knurled surface, ribs or equivalents thereof.

Referring now to at least FIGS. 15-18, an alternative embodiment of the present disclosure is illustrated. Here the first lever 28 is configured to have a substantially linear profile and the contact portion 60 of the second lever 56 is configured as a protruding portion. As such and as the second lever 56 is moved from the first position to the second position, the protruding portion 60 of the second lever 56 contacts a surface of the lower receiver 12 and cause the first lever 28 to pivot away from the lower receiver 12.

Figure 19:
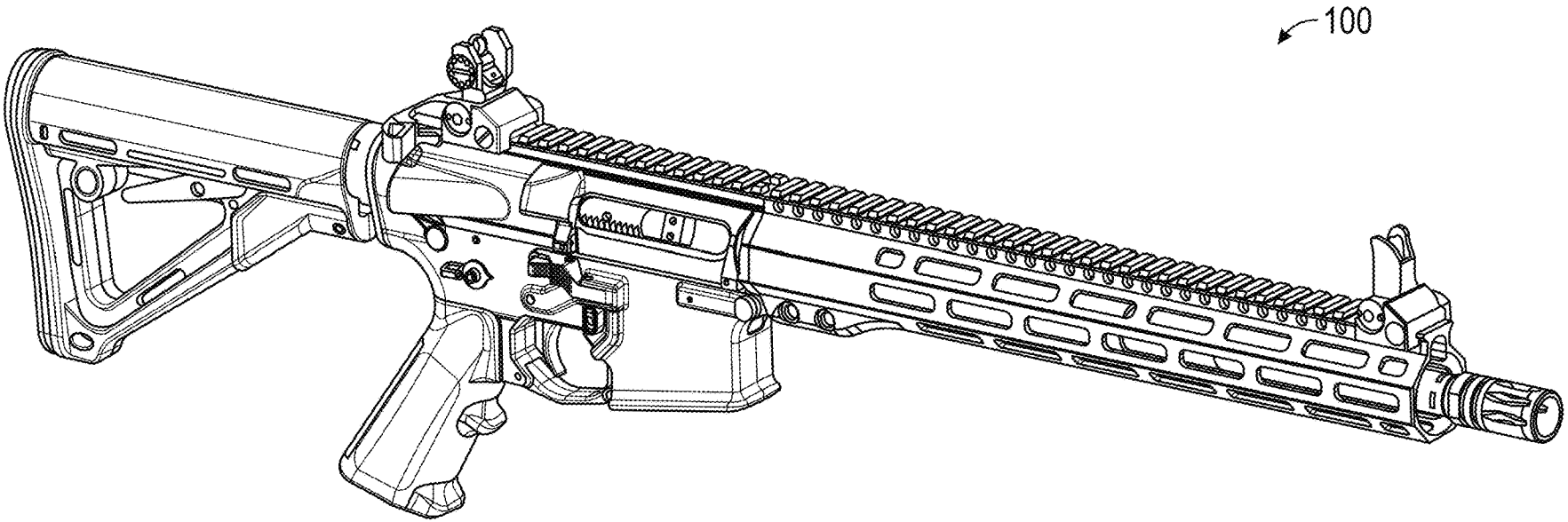
FIG. 19 is a perspective view of a firearm with an ambidextrous bolt catch in accordance with an embodiment of the present disclosure.

FIG. 19 is a perspective view of a firearm 100 with an ambidextrous bolt catch in accordance with an embodiment of the present disclosure.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. An ambidextrous bolt catch for use with a firearm, comprising:

a bolt catch;

a first lever operably coupled to the bolt catch via a connecting pin, wherein movement of the bolt catch causes movement of the first lever and movement of the first lever causes movement of the bolt catch; and a second lever pivotally mounted to the first lever.

2. The ambidextrous bolt catch as in claim 1, wherein the connecting pin is secured to the bolt catch at one end of the connecting pin and an opposite end of the connecting pin is secured to the first lever and the second lever is moveably received within an opening of the first lever.

3. An ambidextrous bolt catch for use with a lower receiver of a firearm, comprising:

a bolt catch pivotally mounted to the lower receiver for movement between a first position and a second position with respect to the lower receiver;

a first lever operably coupled to the bolt catch via a connecting pin, the first lever being pivotally mounted to the lower receiver for movement between a first position and a second position with respect to the lower receiver; and a second lever pivotally mounted to the first lever for movement between a first position and a second position with respect to the first lever, wherein movement of the bolt catch between the first position and the second position causes movement of the first lever between the first position and the second position and movement of the first lever between the first position and the second position causes movement of the bolt catch between the first position and the second position.

4. The ambidextrous bolt catch as in claim 3, wherein movement of the bolt catch from the first position to the second position causes a portion of the bolt catch to move outwardly from a groove in the lower receiver.

5. The ambidextrous bolt catch as in claim 4, wherein the bolt catch further comprises a blocking portion positioned to block forward movement of a bolt, when the bolt catch is in the second position.

6. The ambidextrous bolt catch as in claim 5, wherein the bolt is secured to a bolt carrier movably received within an upper receiver secured to the lower receiver and the second lever is moveably received within an opening of the first lever.

7. The ambidextrous bolt catch as in claim 3, wherein movement of the second lever from the first position to the second position causes the first lever to move from the first position to the second position.

8. The ambidextrous bolt catch as in claim 7, wherein the second lever has a protrusion configured to contact the lower receiver when the second lever is moved from the first position to the second position.

9. The ambidextrous bolt catch as in claim 8, wherein the bolt catch rotates in a first plane and the first lever and the second lever rotate in a second plane, the first plane being orthogonal to the second plane.

10. The ambidextrous bolt catch as in claim 3, wherein the bolt catch is pivotally mounted to the lower receiver via a first pin and the first lever is pivotally mounted to the lower receiver via a second pin, the first pin being orthogonal to the second pin.

11. The ambidextrous bolt catch as in claim 3, wherein a spring is located on the connecting pin and the spring is configured to contact a flange portion of the connecting pin at one end and a flange portion of a first opening in the lower receiver, the first opening being connected to a second opening in the lower receiver, the second opening being smaller than the first opening and the connecting pin extending through both the first opening and the second opening, the first opening and the second opening extending across the lower receiver from a right side of the lower receiver to a left side of the lower receiver.

12. The ambidextrous bolt catch as in claim 11, wherein the spring provides a biasing force to urge the bolt catch from the second position to the first position.

13. The ambidextrous bolt catch as in claim 11, wherein the spring provides a biasing force to urge the first lever from the second position to the first position.

14. The ambidextrous bolt catch as in claim 3, wherein the bolt catch is pivotally mounted to a first side of the lower receiver and the first lever is pivotally mounted to a second side of the lower receiver, the first side of the lower receiver being opposite to the second side of the lower receiver.

15. The ambidextrous bolt catch as in claim 14, wherein the first side of the lower receiver is a left side of the lower receiver and the second side of the lower receiver is a right side of the lower receiver.

16. The ambidextrous bolt catch as in claim 3, wherein the connecting pin is secured to first lever via a ball portion received in a socket.

17. The ambidextrous bolt catch as in claim 3, wherein the bolt catch includes a planar portion that is engageable from a side of the lower receiver in order to move the bolt catch from the second position to the first position.

18. The ambidextrous bolt catch as in claim 3, wherein the bolt catch and the first lever are spring biased into the first position by a single spring.

19. A method for releasing a bolt via an ambidextrous bolt catch secured to a lower receiver of a firearm, comprising:

pivoting a bolt catch pivotally mounted to the lower receiver from a second position to a first position in order to release the bolt being contacted by the bolt catch;

pivoting a first lever pivotally mounted to the lower receiver from a second position to a first second position with respect to the lower receiver, the first lever being operably coupled to the bolt catch via a connecting pin; and pivoting a second lever pivotally mounted to the first lever from a second position to a first position, wherein movement of the bolt catch between the first position and the second position causes movement of the first lever between the first position and the second position and movement of the first lever between the first position and the second position causes movement of the bolt catch between the first position and the second position.

20. The method as in claim 19, wherein movement of the bolt catch from the first position to the second position causes a portion of the bolt catch to move outwardly from a groove in the lower receiver.

* * * * *